US006059045A

United States Patent [19]

Rose et al.

[11] Patent Number: 6,059,045

[45] Date of Patent: May 9, 2000

[54] MECHANISM FOR MECHANICALLY ISOLATING ENERGETIC MATERIAL FEED STREAMS FROM A PROCESSING APPARATUS

[75] Inventors: Michael T. Rose, Tremonton; Andrew C. Haaland, Park City; Steven J. Bradley, North Ogden; Michael R. Harper, Brigham City, all of Utah

[73] Assignee: Cordant Technologies Inc., Salt Lake City, Utah

[21] Appl. No.: 09/119,733

[22] Filed: Jul. 21, 1998

[51] Int. Cl.[7] ..... A62C 3/00

[52] U.S. Cl. ..... 169/48; 169/54; 169/91

[58] Field of Search ..... 169/48, 54, 91

[56] References Cited

FOREIGN PATENT DOCUMENTS 1489-784 6/1989 U.S.S.R. ..... 169/48

1498-508 8/1989 U.S.S.R. ..... 169/48

*Primary Examiner*—Lesley D. Morris

*Attorney, Agent, or Firm*—Pillsbury Madison & Sutro LLP

[57] ABSTRACT

A mechanism for isolating energetic material feed streams from a material processing apparatus includes a deflector conduit having side panels defining a passageway from an entrance to an exit. Openings are formed in the side panels, and deflector baffles are positioned within the passageway adjacent each of the openings. The deflector baffles are arranged obliquely to the side panels so as to permit material to pass through the passageway toward the exit without falling out of the openings, but to deflect flames, propagating through the passageway toward the entrance, out of the openings to substantially prevent the flames from reaching the entrance. A conveyor may be used in conjunction with the deflector conduit to separate the conduit from a material feed hopper. A combustible conduit may be used to direct material into the deflector conduit from the end of a conveyor or from a feed hopper.

11 Claims, 3 Drawing Sheets

MECHANISM FOR MECHANICALLY ISOLATING ENERGETIC MATERIAL FEED STREAMS FROM A PROCESSING APPARATUS

ORIGIN OF INVENTION

This invention was made with government support under U.S. Department of Army contract number DAAA21-94-D-0003. The government has certain rights in the invention.

BACKGROUND AND FIELD OF THE INVENTION

The present invention relates to material handling equipment and more particularly, to a safety mechanism for limiting fire damage within a system for handling and processing energetic materials.

DESCRIPTION OF THE RELATED ART

In the processing of energetic, or combustible, materials, for example, materials used as propellants for rocket motors, the materials typically travel through a material transport system and one or more processing apparatuses. For example, the material may move from a source vessel, or hopper, where the material is stored in bulk, into a material processing device, such as a screw extruder. Different material transporting mechanisms and/or directing structures may be disposed between the source vessel and the material processing apparatus. Because of the highly volatile (energetic) nature of the material being handled and processed, there is always danger of unintentional ignition or runaway reactions of the material at some location in the material transporting and/or processing system. Depending on the material rheology and thermal properties, such as heat capacity and auto-ignition temperature, and due to the high pressures exerted on the material and/or the high shear rate environment within the material processing apparatus, such unintended ignitions may occur in the material processing apparatus.

Once the material is ignited, if the material travels through the material handling and processing system in a continuous stream, or if gaps within that stream are such that they can be traversed by an advancing flame, the flame can propagate rearwardly in the system and back to the source vessel where the energetic material is stored in bulk, thus potentially causing damage to a significant amount of the bulk material handling equipment and destroying a large amount of the energetic material. Moreover, ignition of a bulk amount of material in an enclosed source vessel can lead to large fires and/or explosions, often resulting in collateral damage to facilities and equipment as well as injury to personnel in the area.

Various mechanisms have been employed in attempts to minimize the damage caused by unintended ignitions within material handling and processing systems for energetic materials.

For example, isolation valves have been used within material transporting conduits. The valve is activated by a sensor, typically an ultraviolet or infrared sensor, which shuts off the conduit, thus preventing the flame from propagating through the conduit back to the source vessel. In practice, however, isolation valves present a number of disadvantages. First, due to the nature of the operation of a valve, it is necessary that the valve be disposed within a conduit carrying the energetic material. That is, a limited passageway must be defined which can be closed by the valve when activated. A conduit has the unintended and undesirable effect, however, of actually focusing flames travelling through the material feed stream, thus causing the flame to propagate more rapidly than it might otherwise propagate if the material were not travelling within the limited passageway. In addition, there is necessarily a time delay before the valve operates. First, the sensor must sense the specific property which activates the sensor, next the sensor must send a signal to the valve actuating mechanism, then the valve actuating mechanism must actually close the valve to seal off the conduit. Accordingly, because of the time required for the valve to close off the conduit, combined with the focusing effect of the conduit on the propagating flame, the flame may already have passed the valve by the time the valve closes.

Fast acting deluge systems have also been employed. Such systems include a reservoir of a fire-quenching agent that, upon activation by a sensor, such as an infrared or ultraviolet sensor, deluges the material handling system to suppress the flames to thus limit or prevent further propagation of the flames. Again, because of the reliance on a sensor mechanism, there is necessarily a time delay to activation involved, and the system may not be fast enough to prevent propagation of the flames.

Other mechanisms that have been used include burst disks. A burst disk is a disk of thin metal, typically scored to encourage bursting of the disk at an elevated pressure, that is installed in a flange of a conduit system carrying the energetic material feed stream. Upon build-up of sufficient pressure within the conduit due to an unintended ignition, the disk bursts, thus venting the conduit to atmosphere and reducing the pressure therewithin. With only atmospheric pressure within the conduit, flame propagation can be minimized or stopped, for example, by a deluge system. Again, the problem with a burst disk is that time is required for sufficient pressure to build up in the conduit to cause the disk to burst, and the conduit itself acts to focus the propagating flame so that the burst disk may be ineffective to actually stop propagation of the flame.

Of course, two or more of the above-described safety mechanisms can be used in combination within a system, but, because all of the devices suffer from the same disadvantages, namely, time delay to activation and focusing of the flame in a restricted conduit, using the devices in conjunction with one another does not offset the disadvantages of each of the devices.

SUMMARY OF THE INVENTION

The present invention overcomes the disadvantages of the safety mechanisms described above by providing an apparatus which directs forward material flow within a relatively open passageway but inhibits rearward flame propagation within the passageway without using sensing devices or without changing the state of the mechanism. Therefore, the propagating flame is not focused within a restricted conduit and there is no time delay for the safety mechanism to take effect.

Accordingly, the present invention provides a mechanism for isolating energetic material feed streams from a material processing apparatus through which energetic material moves from an upstream position to a downstream position toward the processing apparatus. The mechanism comprises a material passage structure permitting movement of the energetic material downstream toward the processing apparatus and a flame deflecting structure constructed and arranged to allow the energetic material moving downstream to pass over the flame deflecting structure toward the material processing apparatus and to deflect flames which ignite within the material processing apparatus, to inhibit propagation of the flames upstream past the flame deflecting structure.

In a preferred embodiment, the mechanism includes a deflector conduit which comprises side panels defining a material passageway through which the energetic material moves from an entrance of the conduit toward an exit of the conduit. The side panels include a number of openings formed therein, and the conduit further includes a plurality of deflector baffles disposed within the material passageway and positioned to permit the energetic material to move through the material passageway without falling through the openings and to deflect flames propagating into the passageway from the exit toward the entrance through the openings to substantially prevent the flames from reaching the entrance.

A conveyor system may be used in conjunction with a deflector conduit to transport material from a feed hopper to the entrance of the conduit, and the conveyor may include dividers which define individual compartments to divide the material feed stream into individual discrete portions.

A combustible conduit may be used in conjunction with a deflector conduit to direct material from a conveyor or a feed hopper into the entrance of the deflector conduit. The combustible conduit increases the separation between the processing apparatus and the feed hopper and combusts and disintegrates if flames propagate back into the combustible conduit.

Other objects, features, and characteristics of the present invention will become apparent upon consideration of the following description and the appended claims with reference to the accompanying drawings, all of which form a part of the specification, and wherein like reference numerals designate corresponding parts in the various figures.

DETAILED DESCRIPTION OF THE PREFERRED EMBODIMENT

Figure 1:
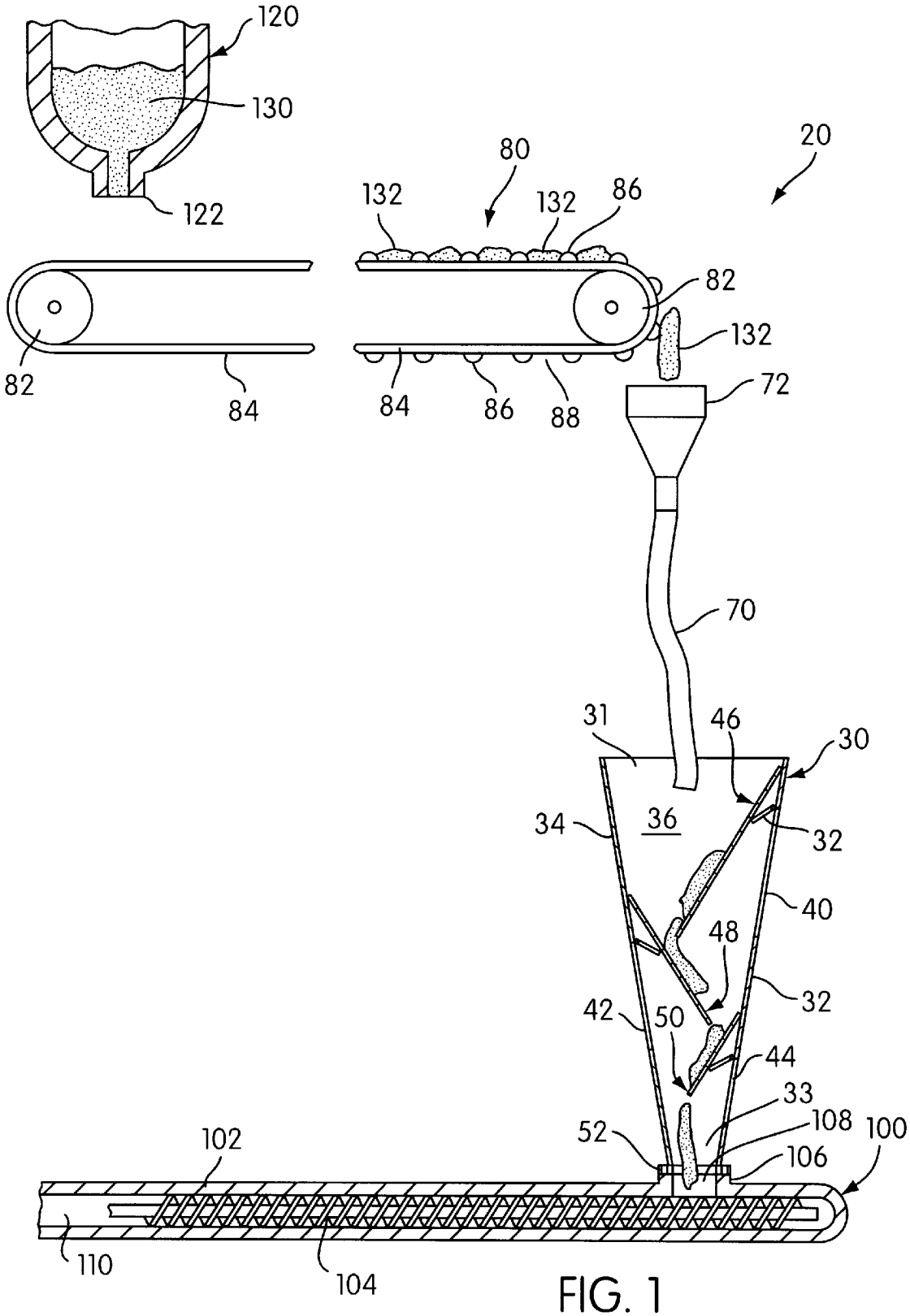
FIG. 1 is a schematic view, partially and cross-section, of a material transporting and processing system incorporating a materials direction and isolating mechanism according to the present invention.

FIG. 1 shows a mechanism for mechanically isolating an energetic material feed stream, designated generally by reference 20, disposed between a material processing apparatus in the form of a screw extruder 100 and a bulk material hopper 120. Although only a single hopper 120 is shown in FIG. 1, the mechanism 20 may be employed to isolate a processing apparatus, such as extruder 100, from more than one hopper, where more than one hopper is used to feed materials into the processing apparatus, such as where the processing apparatus is used to mix different materials.

The hopper (or hoppers) 120 contains a bulk supply of energetic material 130 and may include a discharge spout 122. Discharge of material 130 from the hopper 120 may be controlled by a discharge spout door or a feed screw (not shown). The screw extruder 100 may include a cylindrical tube 102 closed at one end and defining a cylindrical bore 110 therein. A helical screw 104 is operatively disposed within the bore 110, and an entrance opening 108 communicates with the bore 110 and is surrounded by a mounting flange 106.

Both the hopper 120 and the screw extruder 100 are conventional and form no part of the invention, but the isolating mechanism 20 of the present invention is typically used in conjunction with devices such as these. Other types of material processing apparatuses with which the isolating mechanism of the present invention may be used include slurry reactors, material mixers, granulators, centrifuges, grinders, sieves, ovens, and roll mills.

The isolating mechanism 20 includes a structure for deflecting flames and inhibiting their propagation, such as a deflector conduit, generally indicated at 30 and, optionally, a conveyor 80. A combustible conduit 70 is preferably provided above the deflector conduit 30 and a funnel 72 is preferably provided to direct material into the combustible conduit 70. If more than one bulk material hopper is employed, each hopper may have a dedicated conveyor 80 and/or combustible conduit 70 for transferring material from the hopper into the deflector conduit 30.

Figure 4:
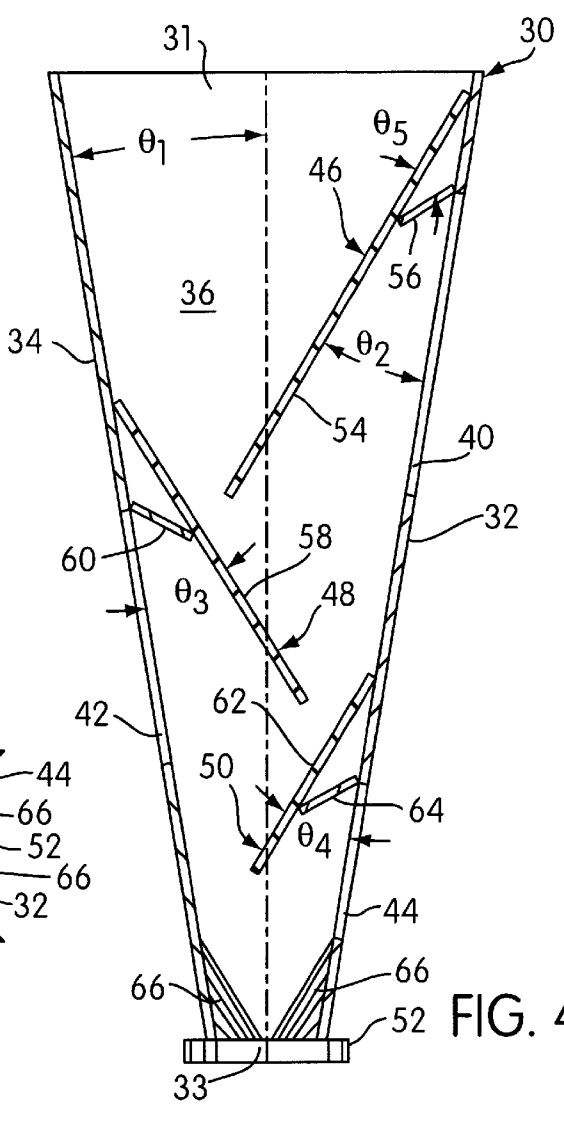
FIG. 4 is a cross-section in the direction IV—IV in FIG. 2.
Figure 3:
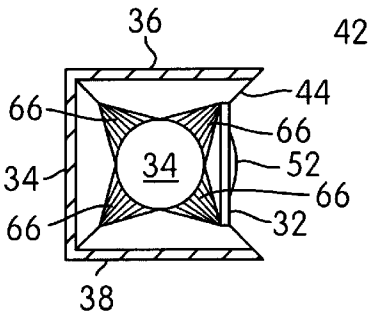
FIG. 3 is a cross-section in the direction III—III in FIG. 2.
Figure 2:
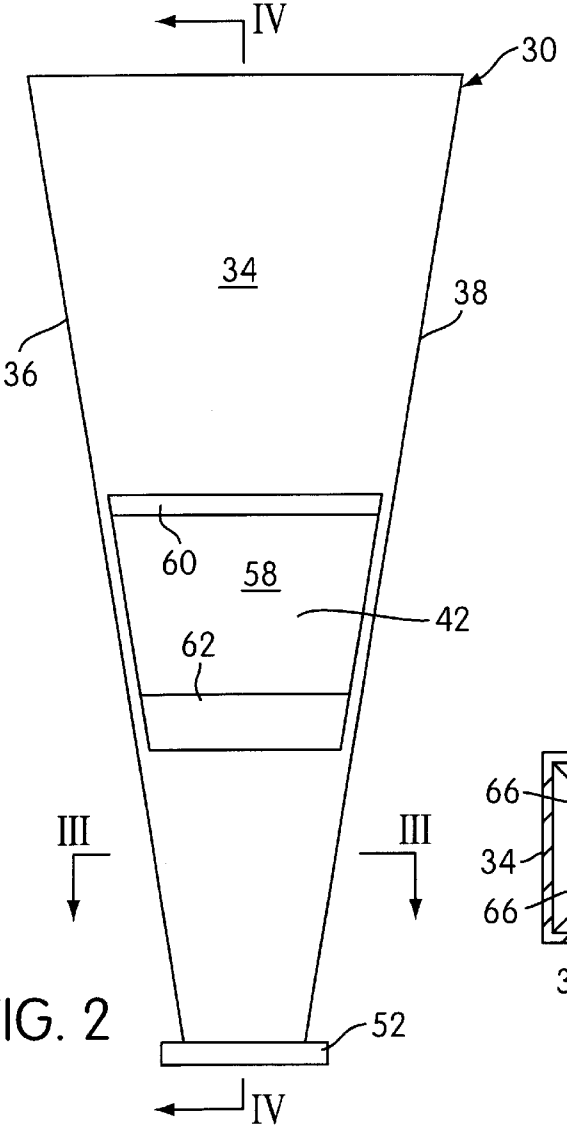
FIG. 2 is a side elevation of a deflector conduit for use in directing and isolating a material feed stream in accordance with the principles of the present invention.

As shown in FIGS. 2–4, deflector conduit 30 includes side panels 32, 34, 36, and 38 arranged so as to define a rectangular transverse cross-section. Furthermore, the side panels define a passageway that is preferably tapered from an entrance 31 thereof to an exit 33 thereof so as to define a funnel for directing material into the entrance opening 108. The passageway defined by deflector conduit 30 may, on the other hand, not be tapered; that is, the transverse area of the passageway may be constant throughout the length of the passageway. In addition, the conduit 30 may be tapered on two sides and straight on two sides.

An opening 42 is formed generally in the middle of side panel 34, and openings 40 and 44 are formed in upper and lower portions, respectively, of side panel 32 facing the side panel 34. For the preferred tapered shape of the deflector conduit 30, the openings 40, 42, 44 are preferably trapezoidal in shape, but may alternatively be rectangular in shape. A deflector baffle 48 extends obliquely from the side panel 34 into the passage from a position above the opening 42. Similarly, a deflector baffle 46 extends obliquely from the side panel 32 into the passage from a position above the opening 40, and a deflector baffle 50 extends obliquely into the passage from the side panel 32 from a position above the opening 44. In the preferred embodiment, three deflector baffles and associated side openings are provided, and it is generally considered that three is an optimum number of baffles and openings, although two or more deflector baffles and associated openings could be provided.

Deflector baffle 46 includes a primary deflector panel 54 extending obliquely from the side panel 32. A secondary deflector panel 56 extends from an intermediate portion of the underside of the primary deflector panel 54 to an upper edge of the opening 40. Deflector baffle 48 includes a primary deflector panel 58 extending obliquely into the passage from the side panel 34 and a secondary deflector panel 60 extending from an intermediate portion of the underside of panel 58 to an upper edge of the opening 42. Similarly, deflector baffle 50 includes a primary deflector panel 62 extending obliquely from the side panel 32 and a secondary deflector panel 64 extending from an intermediate portion of the underside of primary deflector panel 62 to an upper edge of the opening 44. Each deflector baffle 46, 48, 50, including the corresponding primary and secondary deflector panels, extends across the passageway from side panel 36 to side panel 38.

A connecting flange 52 is provided around the periphery of the exit 33 of the deflector conduit 30 for connecting the deflector conduit 30 to a material processing device, such as the connecting flange 106 of the screw extruder 100. If the entrance to the screw extruder 100 is circular, thus requiring a circular connecting flange 52, the corners of the rectangular passageway defined by the side panels 32, 34, 36, and 38 are preferably filled, as at 66 in FIG. 3, to provide a continuous transition between the rectangular cross-section of the passageway of the deflector conduit 30 and the circular exit 33 so that the material passing through the conduit 30 does not get caught up and accumulate in the corners. Preferably, the corners are filled at 66 with welding and are ground smooth to a 63*g* surface. Of course, the smoothness of the fill is dictated by the nature of the material to be passed through the deflector conduit 30. In the present application, the inventors have used the deflector funnel in conjunction with granular energetic materials and molding powders.

The slope and orientation of the side panels and the deflector baffles are also largely determined by the nature of the material to be passed through the deflector conduit 30. In general, it is preferred that the various surfaces over which material passes be as close as possible to vertical so that the material may pass therethrough under the influence of gravity. On the other hand, it is also necessary that the deflector baffles 46, 48, and 50 are oriented so as to have a sufficient horizontal component so that they overlap each other within the passage of the deflector conduit 30.

Depending on the physical properties of the material to be passed through the deflector funnel, it may be desirable to apply a mechanical vibration to the funnel to facilitate material movement through the funnel. Any conventional mechanical vibrating device may be coupled to the funnel to provide the applied vibration.

In the presently preferred embodiment the angles of the side panels and deflector baffles are as follows: $\theta_1$=10–12°; $\theta_2=\theta_3=\theta_4$=18–21°; and $\theta_5$=33°.

Figure 5:
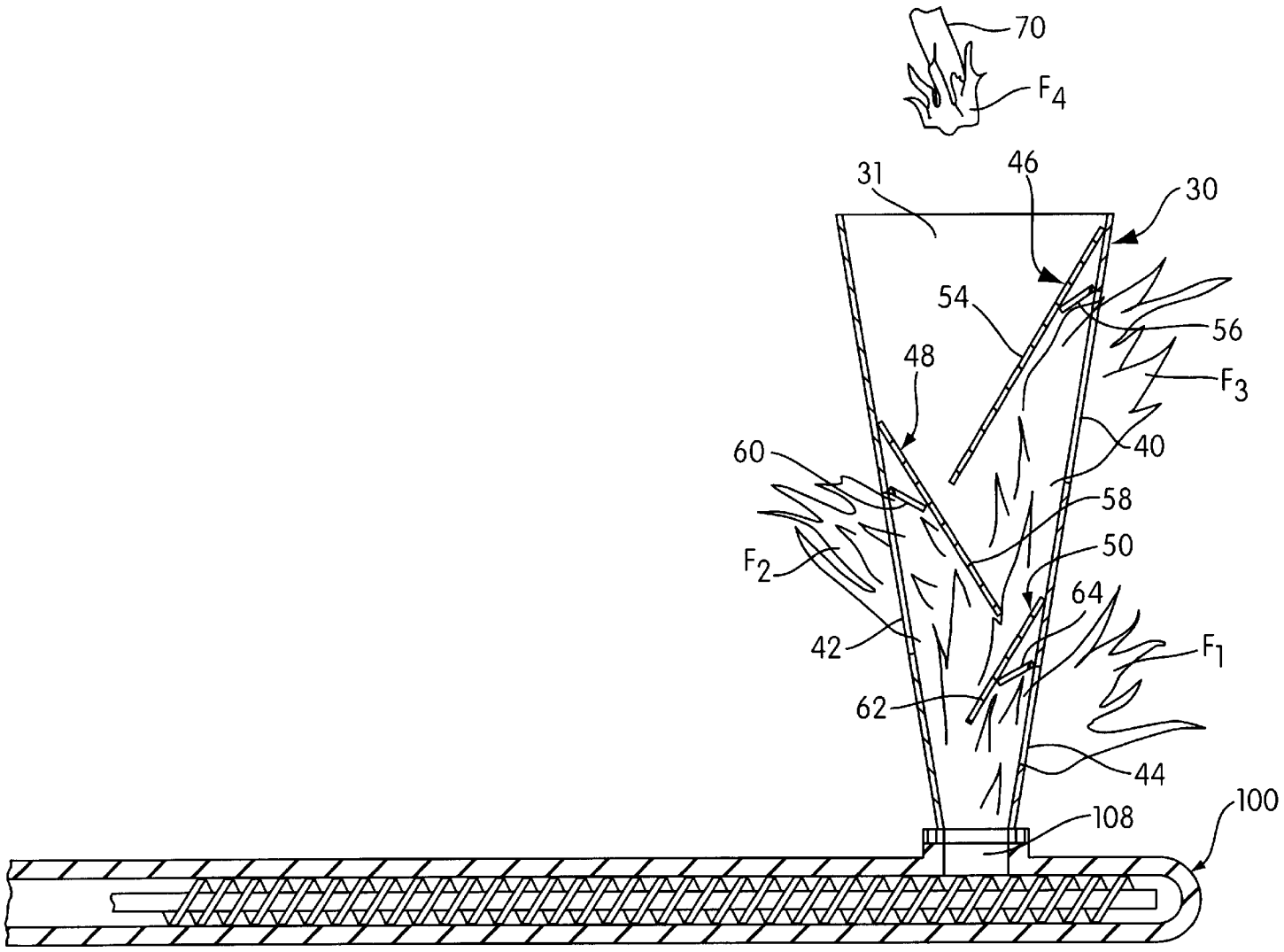
FIG. 5 is a cross-section of a deflector conduit mounted to a material processing apparatus showing the manner in which the funnel mechanically isolates upstream portions of the feed stream from a propagating flame.

The manner in which the deflector conduit 30 prevents rearward, or upstream, propagation of a flame through the system is shown in FIG. 5. If a flame ignites within the screw extruder 100, it will follow the stream of energetic material in the screw extruder rearwardly through the screw extruder entrance 108 and into the deflector conduit 30. The deflector baffles deflect the rearwardly propagating flame through the associated openings so that the flame does not continue to propagate upwardly to the entrance 31 of the deflector conduit 30. That is, a portion $F_1$ of the flame is deflected by the lowest deflector baffle 50 through the opening 44. In that regard, the primary deflector panel 62 and the secondary deflector panel 64 of the first deflector baffle 50 provide two turning surfaces that incrementally turn the flame $F_1$ toward the opening 44.

Because of the overlap of the deflector baffles, flames that manage to get past the first deflector baffle 50 encounter the second deflector baffle 48. The flames $F_2$ are then deflected incrementally by the primary deflector panel 58 and secondary deflector panel 60 through the opening 42. Finally, any remaining flames which get past the second deflector baffle 48 encounter the third deflector baffle 46. The flames $F_3$ are turned incrementally by the primary deflector panel 46 and the secondary deflector panel 56 through the opening 40. Additional deflector baffles and associated openings may be provided if necessary.

In addition to deflecting the flames, if the deflector conduit 30 is tapered from the entrance 31 to the exit 33, the increasing cross-sectional area of the passageway progressing backward toward the entrance 31 serves to decrease combustion pressure within the passageway, thus slowing, or at least not accelerating, flame propagation.

As described, the secondary deflector panels 56, 60 and 64 provide secondary deflecting surfaces to incrementally deflect flames through the associated openings 40, 42, and 44, respectively. In addition, the secondary deflector panels serve as gusset structure to provide support to the associated primary deflector panels 54, 58, and 62, respectively.

The isolating mechanism 20 preferably also includes a conveyor 80, although a conveyor is not considered critical to operation of the mechanism 20. Conveyor 80 includes guide wheels 82 and an endless belt 84 mounted for movement on the guide wheels 82. Conveyor 80 may also include a plurality of spaced, transversely oriented cleats 86 attached to the endless belt 84, as shown on the right side of conveyor 80 in FIG. 1. The cleats 86 divide the belt 84 into distinct individual compartments 88. The top surfaces of the cleats 86 are preferably rounded or otherwise shaped so that material discharged onto the conveyor 80 will not cling to the tops of the cleats 86 but will fall one direction or the other into the compartments 88 adjacent each cleat 86 and form discrete portions 132 of energetic material. Alternatively, the conveyor 80 may have only a continuous undivided belt 84, as shown on the left side of the conveyor 80 in FIG. 1.

The conveyor 80 is an advantageous, but not critical, component of the isolating mechanism 20 because it creates a spatial separation between the discharge 122 of the hopper 120 and the entrance 31 of the deflector conduit 30. Accordingly, should the deflector conduit 30 fail to prevent all flame from propagating back to the entrance 31 of the conduit 30, the conveyor 80 creates a distance over which the flame must propagate to reach the hopper 120. The propagation time required for the flame to traverse the separation distance provides more time for other fire suppression systems, such as a fast-acting deluge system described in the "Background" section above, which may be used in conjunction with the isolating mechanism 20, to be activated to suppress the flames before they reach the hopper 120.

The mechanism 20 for isolating energetic material may also include a combustible conduit 70. Combustible conduit 70 is preferably in the form of a flexible open-ended "sock" formed from combustible materials. The conduit 70, along with the associated funnel 72, permits the deflector conduit 30 to be separated by a distance from the end of the conveyor 80 or from the discharge 122 of the hopper 120 if a conveyor is not employed. The combustible conduit 70 is preferably about six feet long. The increased distance between the deflector conduit 30 and the conveyor 80 or hopper 120 increases the propagation time required for any flames which propagate beyond the entrance of the deflector conduit 30 to reach the conveyor 80 or hopper 120. Accordingly, ancillary fire suppression systems will have more time in which to activate and suppress any flames propagating past the deflector conduit 30.

To prevent the conduit 70 itself from becoming a means for focusing flames, and thereby accelerating propagation, combustible conduit 70 is preferably formed of a combustible material, such as plastic, so that the conduit itself will burn and disintegrate should flames reach it, as shown in FIG. 5, in conduit 70 is burned by flame $F_4$. In addition, to prevent electrostatic build-up within the combustible conduit 70, due to the flow of material through the conduit 70 a conductive plastic material is preferably employed, and the conduit 70 and funnel 72 are grounded to dissipate static electricity. A material known as Velostat®, available from the 3M Corporation of St. Paul, Minn., has been used successfully.

During the operation of the processing system, a stream of the energetic material 130 is released from the hopper 120, and may be deposited onto the conveyor 80. The endless belt 84 moves continuously downstream toward the deflector conduit 30 (clockwise in FIG. 1), the conveyor 80 dumps the energetic material into the funnel 72, the material flows through the combustible conduit to and into the deflector conduit 30. If the conveyor 80 includes cleats 86, discrete portions of energetic material 132 are directed into the deflector conduit 30, otherwise, a continuous stream of energetic material 130 is directed into the deflector conduit 30. Within the deflector conduit 30, each discrete portion 132 or the continuous stream travels downstream in a serpentine path over the deflector baffles 46, 48, and 50 toward the exit 33 of the conduit 30. As can be appreciated from the figures, the construction and orientation of the deflector baffles 46, 48, and 50 permit the material to pass through the conduit 30, while being directed into the entrance 108 of the extruder 100, but, because each of the deflector baffles 46, 48, 50 extends beyond a center line of the funnel 30, there is no straight vertical pathway through the deflector conduit 30 for the energetic material to travel directly into the extruder 100.

Conveyor cleats 86 may be used if the energetic material is particularly volatile. As described above, cleats 86 divide the energetic material into discrete portions 132, and thus a continuous feed stream of energetic material through the deflector conduit 30 is avoided. Accordingly, flame propagation through the conduit 30 is disrupted because of the absence of a continuous path of fuel.

The material of the deflector funnel may be any suitable rigid material that can withstand heat and flames. The material is also preferably electrically conductive so that the deflector funnel can be grounded to prevent static charge build-up within the funnel. In the preferred embodiment, the conduit 30 is made of stainless steel because of the corrosive nature of the energetic material, the ease with which stainless steel can be cleaned, and the ease of fabrication. Each of the panels that form the sides and the primary and secondary deflector panels of the conduit 30 can be stamped out of sheet stock and can be secured to one another at their points of contact by welding.

It will be realized that the foregoing preferred specific embodiment of the present invention has been shown and described for the purposes of illustrating the functional and structural principles of this invention and are subject to change without departure from such principles. Therefore, this invention includes all modifications encompassed within the spirit and scope of the following claims.

What is claimed is:

1. A mechanism for isolating energetic material feed streams from a material processing apparatus through which energetic material moves from an upstream position to a downstream position toward the processing apparatus, said mechanism comprising:

a material passage structure permitting movement of the energetic material downstream toward the processing apparatus; and flame deflecting structure constructed and arranged to allow the energetic material moving downstream to pass over said flame deflecting structure toward the material processing apparatus and to deflect flames which ignite within the material processing apparatus, to inhibit propagation of the flames to an upstream position past said flame deflecting structure, said flame deflecting structure including a deflector conduit, said deflector conduit comprising:

side panels defining a material passageway having an entrance and an exit through which the energetic material moves from said entrance toward said exit, said side panels having openings formed therein; and deflector baffles disposed within said material passageway and being positioned and oriented to permit the energetic material to move through the material passageway without falling through said openings and to deflect flames propagating into said passageway from said exit toward said entrance through said openings to substantially prevent the flames from reaching said entrance.

2. The mechanism for isolating energetic material feed streams of claim 1 wherein the area of said entrance is larger than the area of said exit, and said material passageway is tapered from said entrance to said exit.

3. The mechanism for isolating energetic material feed streams of claim 1, said material passage structure including a conveyor system for transporting energetic material from an upstream position to a downstream position toward the material processing apparatus and for creating a spatial separation between the upstream position and the downstream position.

4. The mechanism for isolating energetic material feed streams of claim 3, wherein said conveyor system comprises a continuous belt carried for conveying movement on rollers.

5. The mechanism for isolating energetic material feed streams of claim 4, wherein said conveyor system further comprises a plurality of spaced, divider elements, attached transversely to said continuous belt to define individual compartments between adjacent divider elements for dividing the energetic material feed stream into a plurality of discrete portions of energetic material.

6. The mechanism for isolating energetic material feed streams of claim 1, wherein said deflector conduit includes at least two openings formed in said side panels and at least two deflector baffles, one deflector baffle associated with each of said openings.

7. The mechanism for isolating energetic material feed streams of claim 6, wherein said deflector conduit includes three openings formed in said side panels and three deflector baffles, one deflector baffle associated with each of said openings.

8. The mechanism for isolating energetic material feed streams of claim 1, wherein said deflector conduit includes four side panels arranged to define a material passageway having a rectangular transverse cross-section.

9. The mechanism for isolating energetic material feed streams of claim 8, wherein said deflector conduit includes three openings formed in said side panels, two openings being formed in one side panel and one opening being formed in an opposed side panel, and three deflector baffles, one deflector baffle associated with each of said openings and extending into said material passageway from the side panel in which the associated opening is formed.

10. The mechanism for isolating energetic material feed streams of claim 1, wherein each of said deflector baffles is associated with a one of said openings and wherein each of said deflector baffles comprises a primary deflector panel extending from the side wall in which the associated opening is formed from a position spaced from an upper edge of the associated opening, and a secondary deflector panel extending from an intermediate portion of said primary deflector panel to the upper edge of the associated opening.

11. The mechanism for isolating energetic material feed streams of claim 1, said material passage structure including a combustible conduit disposed upstream of said deflector conduit for directing energetic material into said entrance of said deflector conduit, said combustible conduit being formed from a combustible material, so that flames which propagate upstream past said entrance of said deflector conduit ignite and burn said combustible conduit.

* * * * *